US011133141B2

(12) United States Patent
Belisle

(10) Patent No.: US 11,133,141 B2
(45) Date of Patent: Sep. 28, 2021

(54) RELAY CONTACTOR DUAL LINEAR ACTUATOR MODULE SYSTEM

(71) Applicant: Hamilton Sundstrand Corporation, Charlotte, NC (US)

(72) Inventor: Francis C. Belisle, Roscoe, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 225 days.

(21) Appl. No.: 16/270,364

(22) Filed: Feb. 7, 2019

(65) Prior Publication Data

US 2020/0258708 A1 Aug. 13, 2020

(51) Int. Cl.

| | |
|---|---|
| ***H01H 50/20*** | (2006.01) |
| ***H01H 50/64*** | (2006.01) |
| ***H01H 50/44*** | (2006.01) |
| ***H01H 50/54*** | (2006.01) |

(52) U.S. Cl.
CPC ..... *H01H 50/641* (2013.01); *H01H 50/20* (2013.01); *H01H 50/44* (2013.01); *H01H 50/54* (2013.01); *H01H 50/546* (2013.01)

(58) Field of Classification Search
CPC ..... H01H 1/20–2001/2033; H01H 50/546
USPC ..... 335/132, 259, 266–268
See application file for complete search history.

(56) References Cited

U.S. PATENT DOCUMENTS

| | | | | |
|---|---|---|---|---|
| 1,503,717 A | | 8/1924 | Smith | |
| 2,725,488 A | * | 11/1955 | Hueffed | H02J 7/1423 307/48 |
| 2,919,324 A | | 12/1959 | Schuessler | |
| 3,836,879 A | | 9/1974 | Frye | |
| 4,529,953 A | * | 7/1985 | Myers | H01H 51/005 335/126 |
| 6,958,671 B2 | * | 10/2005 | Chen | H01H 9/42 335/132 |
| 8,559,149 B2 | | 10/2013 | Wavering et al. | |
| 2008/0143462 A1 | | 6/2008 | Belisle et al. | |

FOREIGN PATENT DOCUMENTS

| | | |
|---|---|---|
| DE | 604819 C | 10/1934 |
| EP | 3116014 A1 | 1/2017 |

OTHER PUBLICATIONS

European Search Report Applicaton No. EP19209702: dated Jul. 7, 2020; pp. 7.

* cited by examiner

*Primary Examiner* — Ramon M Barrera
(74) *Attorney, Agent, or Firm* — Cantor Colburn LLP

(57) ABSTRACT

A relay contactor is provided and includes input and output leads, a shaft assembly, an actuator and first and second bearing assemblies. The shaft assembly includes a shaft, a plate disposed on the shaft and an elastic element. The shaft and the plate are movable between an open position at which the plate is displaced from the input and output leads and a closed position at which the plate contacts the input and output leads. The actuator is coupled to the shaft at a first side of the plate and is configured to selectively move the shaft and the plate into the closed position in opposition to bias applied by the elastic element. The first and second bearing assemblies are disposed to movably support the shaft at the first side and at a second side of the plate, respectively.

15 Claims, 6 Drawing Sheets

RELAY CONTACTOR DUAL LINEAR ACTUATOR MODULE SYSTEM

BACKGROUND

The following description relates to relay contactors and, more particularly, to a relay contactor with a dual linear actuator module system.

The present standard for high amperage relays or contactors is to have a single linear motor actuator with an armature mechanically connected to movable electrical contacts by way of a shaft assembly. The armature and the shaft assembly are supported only on the side of the motor and the movable electrical contacts are provided on a free, unsupported end of the shaft assembly.

The single linear motor actuator includes a stator with a coil winding or windings. The armature passes through the single linear motor actuator structure on bushings and with linkages, including springs and other similar features, on the end of the shaft assembly, which is provided as a cantilever structure, and which is connected to the movable electrical contacts.

As amperage increases in power levels to 1000's of amperes at steady state (the present aerospace production component high amperage is around 450A), the electrical connections have to significantly increase in size in order to handle the amperage power flow. As such, the electrical movable contact masses (i.e., combined mechanical and electrical elements are increased. With the high mass electrical movable contacts provided on the free end of a shaft assembly, the armature, the shaft assembly and the electrical movable contacts become mechanically difficult to hold in vibratory modes and to move to achieve high speed switching.

BRIEF DESCRIPTION

According to an aspect of the disclosure, a relay contactor is provided and includes input and output leads, a shaft assembly, an actuator and first and second bearing assemblies. The shaft assembly includes a shaft, a plate disposed on the shaft and an elastic element. The shaft and the plate are movable between an open position at which the plate is displaced from the input and output leads and a closed position at which the plate contacts the input and output leads. The actuator is coupled to the shaft at a first side of the plate and is configured to selectively move the shaft and the plate into the closed position in opposition to bias applied by the elastic element. The first and second bearing assemblies are disposed to movably support the shaft at the first side and at a second side of the plate, respectively.

In accordance with additional or alternative embodiments, a housing houses the input and output leads, the shaft assembly, the actuator and the first and second bearing assemblies.

In accordance with additional or alternative embodiments, the input and output leads include first and second conductive elements, respectively, and the plate includes third and fourth conductive elements that are disposed to contact the first and second conductive elements, respectively, when the shaft and the plate are moved into the closed position.

In accordance with additional or alternative embodiments, the shaft extends through a space defined between the input and output leads, the actuator and the first bearing assembly are disposed on a first side of the input and output leads and the plate and the second bearing assembly are disposed on a second side of the input and output leads.

In accordance with additional or alternative embodiments, the elastic element is anchored at opposite ends thereof to the actuator and the shaft or the plate.

In accordance with additional or alternative embodiments, the actuator includes a linear actuator.

In accordance with additional or alternative embodiments, the actuator includes an armature through which the shaft extends, coils surrounding the armature and an actuator housing supportive of the first bearing assembly and configured to house the armature and the coils.

According to an aspect of the disclosure, a relay contactor is provided and includes input and output leads, a shaft assembly, first and second actuators and first and second bearing assemblies. The shaft assembly includes a shaft, a plate disposed on the shaft and an elastic element. The shaft and the plate are movable between an open position at which the plate is displaced from the input and output leads and a closed position at which the plate contacts the input and output leads. The first and second actuators are coupled to the shaft at first and second sides of the plate, respectively, and are configured to selectively move the shaft and the plate into the closed position in opposition to bias applied by the elastic element. The first and second bearing assemblies are disposed to movably support the shaft at the first and second sides of the plate, respectively.

In accordance with additional or alternative embodiments, a housing houses the input and output leads, the shaft assembly, the first and second actuators and the first and second bearing assemblies.

In accordance with additional or alternative embodiments, the input and output leads include first and second conductive elements, respectively, and the plate includes third and fourth conductive elements that are disposed to contact the first and second conductive elements, respectively, when the shaft and the plate are moved into the closed position.

In accordance with additional or alternative embodiments, the first, second, third and fourth conductive elements are disposed at an angle.

In accordance with additional or alternative embodiments, the first, second, third and fourth conductive elements are hemispherical.

In accordance with additional or alternative embodiments, the shaft extends through a space defined between the input and output leads, the first actuator and the first bearing assembly are disposed on a first side of the input and output leads and the plate, the second actuator and the second bearing assembly are disposed on a second side of the input and output leads.

In accordance with additional or alternative embodiments, the elastic element includes a first elastic element anchored at opposite ends thereof to the first actuator and the shaft and a second elastic element anchored at opposite ends thereof to the second actuator and the shaft or the plate.

In accordance with additional or alternative embodiments, the first and second actuators are independently or dependently operable.

In accordance with additional or alternative embodiments, the first and second actuators each include a linear actuator.

In accordance with additional or alternative embodiments, the first actuator includes a first armature through which the shaft extends, first coils surrounding the first armature and a first actuator housing supportive of the first bearing assembly and configured to house the first armature and the first coils and the second actuator includes a second armature through which the shaft extends, second coils surrounding the second armature and a second actuator housing supportive of the second bearing assembly and configured to house the second armature and the second coils.

According to another aspect of the disclosure, a relay contactor is provided and includes first and second pairs of input and output leads, a shaft assembly, first and second actuators and first and second bearing assemblies. The shaft assembly includes a shaft, a plate disposed on the shaft and an elastic element. The shaft and the plate are movable between first and second positions at which the plate is positioned at first and second positions with respect to the first and second pairs of the input and output leads, respectively. The first and second actuators are coupled to the shaft at first and second sides of the plate, respectively, and are configured to selectively move the shaft and the plate between the first and second positions in opposition to bias applied by the elastic element. The first and second bearing assemblies are disposed to movably support the shaft at the first and second sides of the plate, respectively.

In accordance with additional or alternative embodiments, the first position is characterized in that the plate is displaced from the first pair of the input and output leads and in contact with the second pair of the input and output leads and the second position is characterized in that the plate is displaced from the second pair of the input and output leads and in contact with the first pair of the input and output leads.

In accordance with additional or alternative embodiments, the first position is characterized in that the plate is displaced from the first and second pairs of the input and output leads and the second position is characterized in that the plate is in contact with the first and second pairs of the input and output leads.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

These and other advantages and features will become more apparent from the following description taken in conjunction with the drawings.

DETAILED DESCRIPTION

While a single linear actuator motor is now provided as an industry standard, it is characterized as having movable electrical contacts at a free, unsupported end of a shaft with high masses to handle the high power requirements of aerospace applications. This leads to the armature and the shaft being difficult to move during high-speed switching and to the armature and shaft having a tendency to vibrate. Thus, as will be described below, a linear motor design is provided in which the armature is supported on both ends of the shaft. In an exemplary case, a contactor or a large relay actuator system is provided with moveable electrical contacts between two or dual separate linear motor coil actuator assemblies, so that the actuator armature and shaft system is mechanically supported on both ends. This dual motor actuator configuration can allow the armature, springs, insulators and sliding bearings to be configured to optimize the movable structure for large electrical conductors (high amperage) in high vibration environments.

Figure 1:
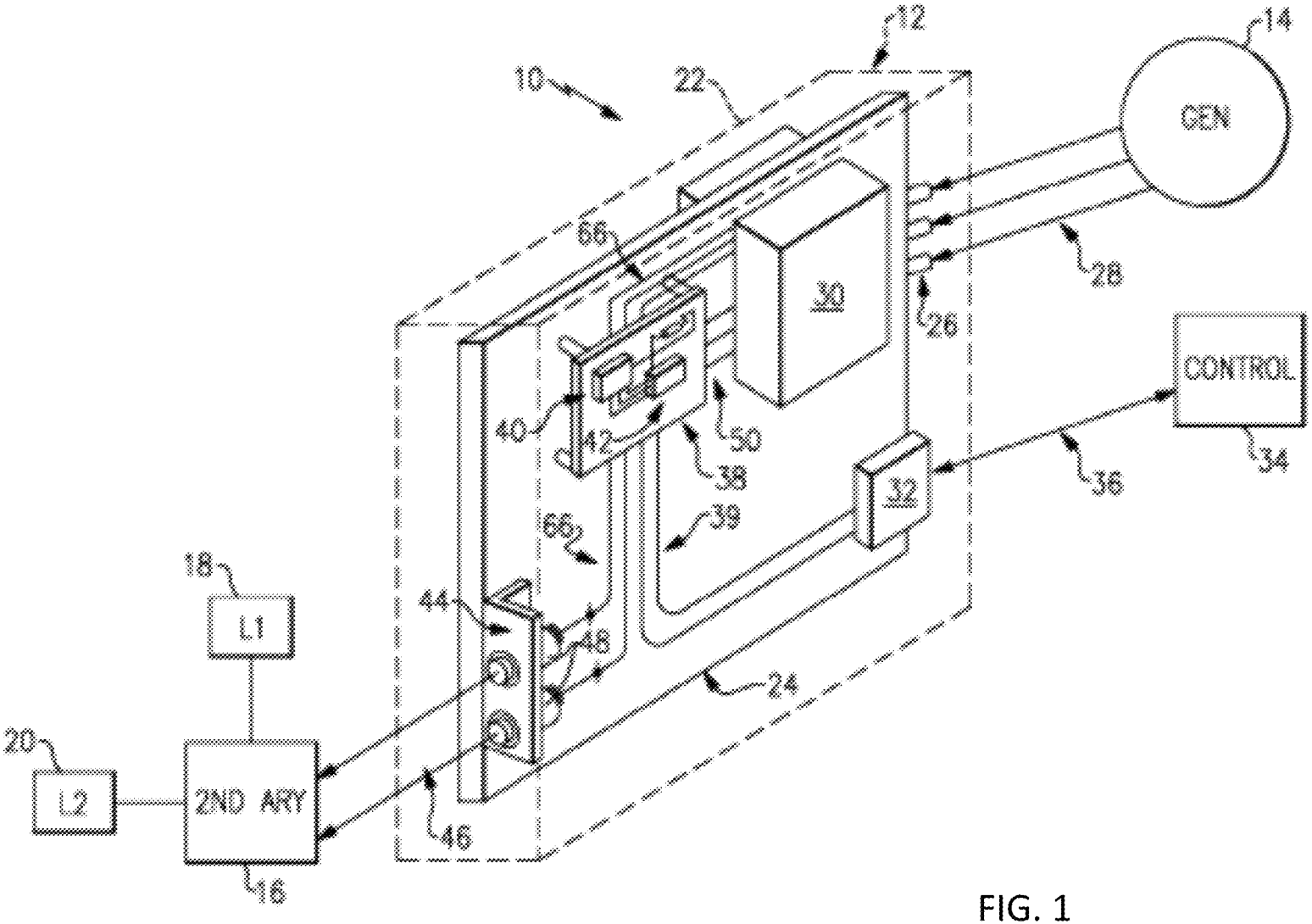
FIG. 1 is a schematic view of an aircraft power distribution system with a generator and a module with an integrated relay contactor.
Figure 2:
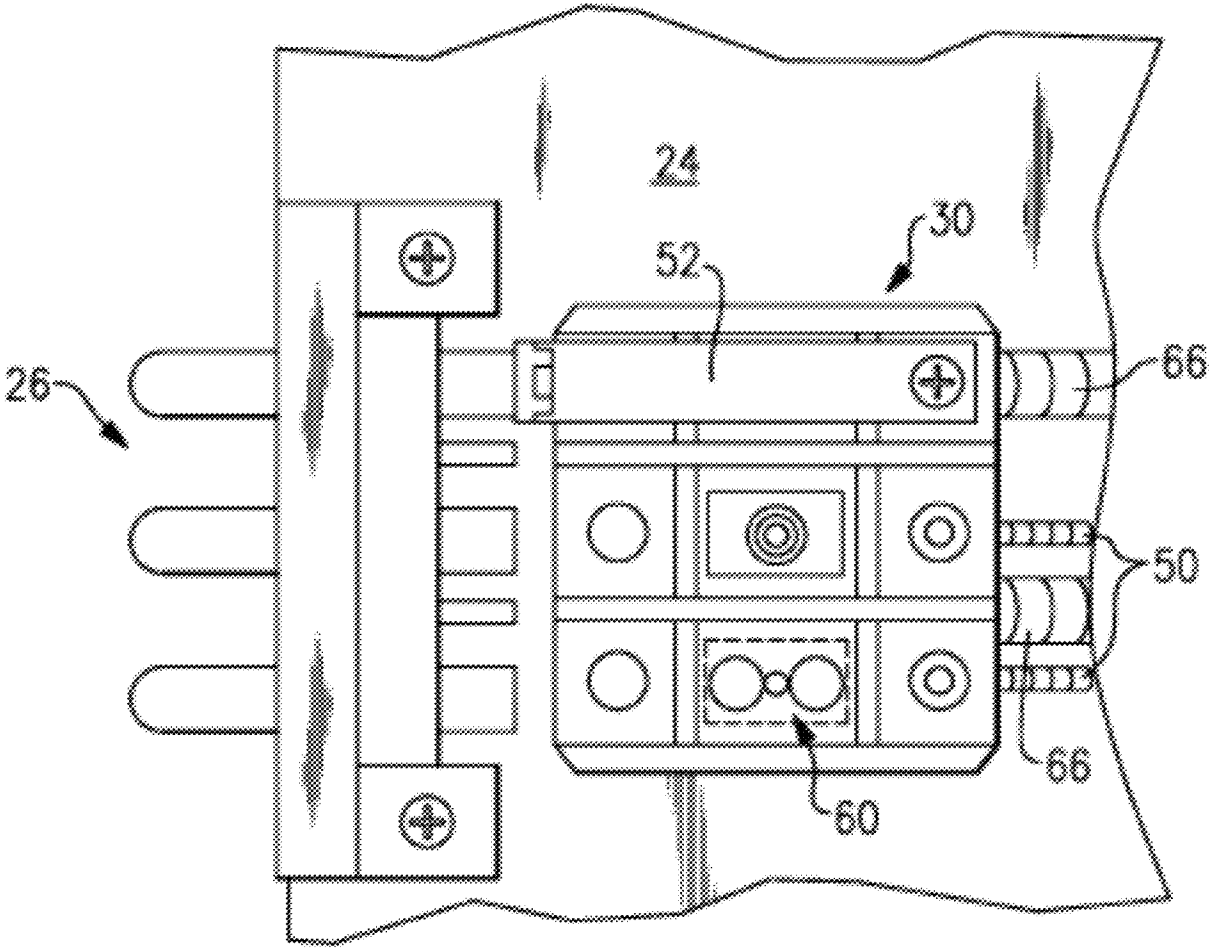
FIG. 2 is a top elevation view of a portion of a primary power distribution board shown in FIG. 1 with an integrated relay contactor.

With reference to FIGS. 1 and 2, an aircraft power distribution system 10 includes a primary power distribution box 12 that receives power from a generator 14 through power leads 28. The primary power distribution box 12 provides power through supply leads 46 to a secondary power distribution box 16, which distributes power to first and second loads 18 and 20, for example.

The primary power distribution box 12 includes a board 24 that is arranged within a housing 22. The board 24 supports plug-in pins 26 that are connected to the power leads 28. Mechanical contactors 30 act as switches to selectively electrically connect the power leads 28 to the supply leads 46. Circuit breakers 48 are supported by the board 24 to selectively disconnect the supply leads 46 from power in response to an overload. The board 24 also supports a connector 32 that communicates with a control 34 through a harness 36. The control 34 provides commands to the board 24 and/or a secondary circuit board 38 and receives feedback regarding various functions related to the aircraft power distribution system 10. The secondary circuit board 38 is mounted on the board 24 and is connected to the connector 32 and contactors 30 through connections 39. The secondary circuit board 38 includes protection circuitry 40 and secondary power distribution circuitry 42. The protection circuitry 40 monitors the current provided by the generator 14, for example, to prevent the secondary power distribution box 16 from exposure to undesired currents. The secondary power distribution circuitry 42 commands the contactors 30 between open and closed positions.

The contactors 30 are illustrated with control traces 50 and power traces 66 which are supported by the board 24 and connected to the secondary circuit board 38 and secondary power distribution connectors 44, respectively. The board 24 is relatively thick to accommodate the current flowing through the power traces 66. The contactors 30 are connected to the plug-in pins 26 by first bands 52 and second bands (not shown). The power traces 66 are selectively provided with power when a plate 60 is moved into a closed position connecting first and second contacts. The plate 60 is moved between open and closed positions by a linear motor and shaft assembly to be described below. The linear motor and shaft assembly is mounted to the board 24 and is commanded by the secondary power distribution circuitry 42 through the control traces 50. The current flowing through the power traces 66 is monitored by the protection circuitry 42 through the control traces 50.

Figure 3:
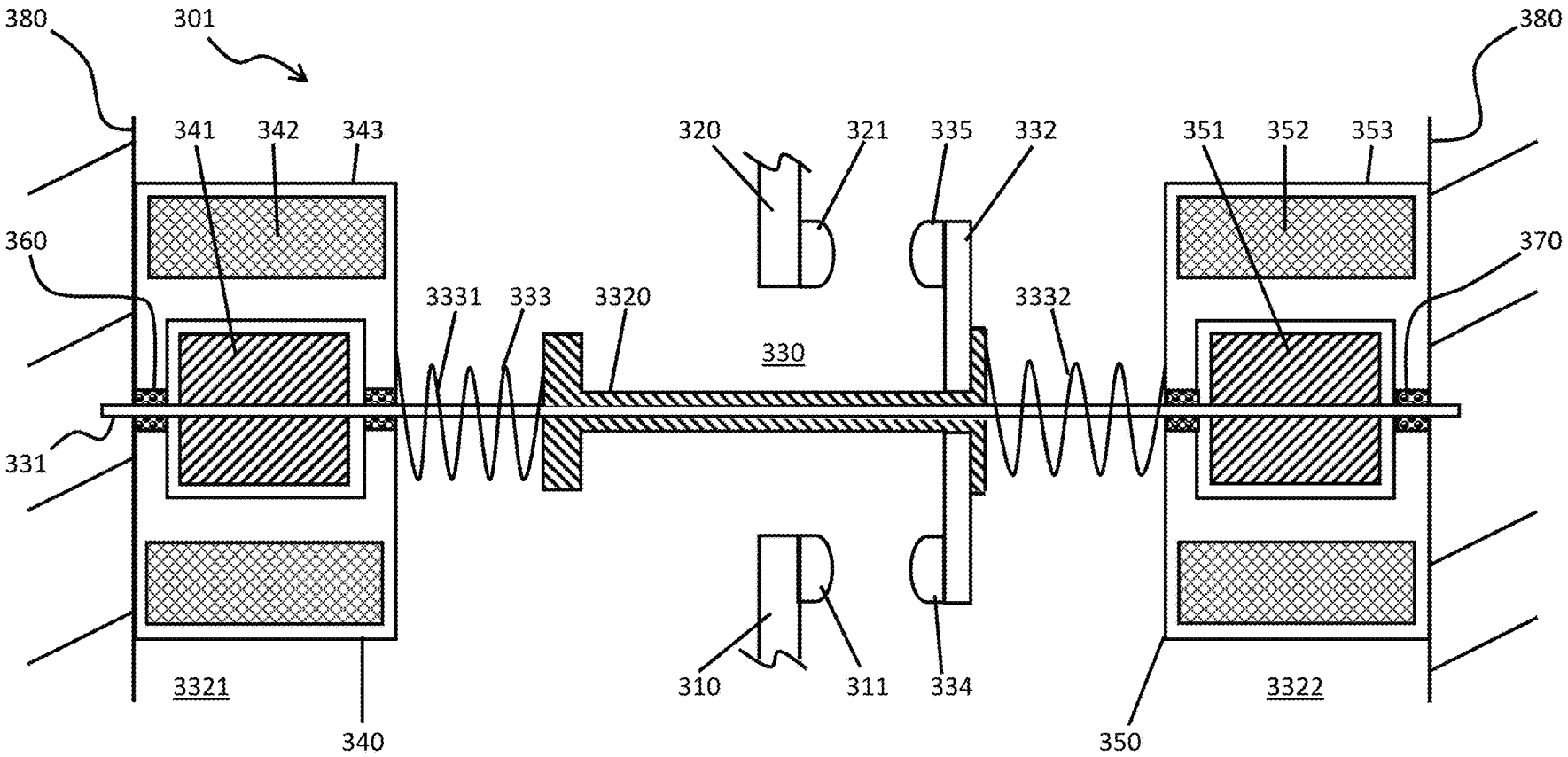
FIG. 3 is a side schematic illustration of a relay contactor for use with the aircraft distribution system of FIG. 1 and the primary power distribution board of FIG. 2 in accordance with embodiments.

With reference to FIG. 3, a relay contactor 301 is provided for use in or as the contactors 30 of FIGS. 1 and 2. As shown in FIG. 3, the relay contactor 301 includes an input lead 310 that is configured to carry current supplied from the power leads 28 of FIG. 2, an output lead 320 that is configured to carry current to the power traces 66 of FIG. 2, a shaft assembly 330, first and second actuators 340 and 350 and first and second bearing assemblies 360 and 370. The relay contactor 301 may further include a housing 380, which is configured to house respectively portions of the input lead 310 and the output lead 320, the shaft assembly 330, the first and second actuators 340 and 350 and the first and second bearing assemblies 360 and 370.

The input lead 310 includes an electrically conductive body that extends to an exterior of the housing 380 and a first electrical contact 311 at a proximal end of the electrically conductive body within the housing 380. The output lead 320 includes an electrically conductive body that extends to an exterior of the housing 380 and a second electrical contact 321 at a proximal end of the electrically conductive body within the housing 380.

The shaft assembly 330 includes a shaft 331 that can span the housing 380, a plate 332 that is disposed on the shaft 331, shaft isolation sleeve 3320 that is interposed between the shaft 331 and the plate 332 and an elastic element 333. The plate 332 includes an electrically conductive body and third and fourth electrical contacts 334 and 335 at opposite ends of the electrically conductive body. The shaft 331 and the plate 332 are movable together along a longitudinal axis of the shaft 331 between an open position and a closed position. At the open position, the third and fourth electrical contacts 334 and 335 of the plate 332 are displaced from electrical contact with the first electrical contact 311 of the input lead 310 and from electrical contact with second electrical contact 321 of the output lead 320, respectively, such that the input lead 310 and the output lead 320 are not electrically communicative with one another (i.e., current from the power leads 28 is not transmitted to the power traces 66). At the closed position, the third and fourth electrical contacts 334 and 335 of the plate 332 are disposed in electrical contact with the first electrical contact 311 of the input lead 310 and in electrical contact with second electrical contact 321 of the output lead 320, respectively, such that the input lead 310 and the output lead 320 are electrically communicative (i.e., current from the power leads 28 is transmitted to the power traces 66). The shaft isolation sleeve 3320 serves to electrically insulate or isolate the plate 332 from the shaft 331. The elastic element 333 can be disposed to apply a bias to the shaft 331 and the plate 332 which urges the shaft 331 and the plate 332 toward assumption of the open position.

In accordance with embodiments, the first and second electrical contacts 311 and 321 and the third and fourth electrical contacts 334 and 335 can be hemispherical or otherwise curved, flat-faced or otherwise configured to form reliable electrical contacts.

The first actuator 340 is coupled to the shaft 331 at a first side 3321 of the plate 332. The second actuator 350 is coupled to the shaft 331 at a second side 3322 of the plate 332. The first and second actuators 340 and 350 are configured to be independently or dependently operable so as to selectively move the shaft 331 and the plate 332 into the closed position in opposition to bias applied by the elastic element 333.

In accordance with embodiments, the first actuator 340 may include or be provided as a linear actuator. In this or other cases, the first actuator 340 may include a first armature 341 through which the shaft 331 extends, first coils 342 surrounding the first armature 341 and a first actuator housing 343 that is supportive of the first bearing assembly 360 and configured to house the first armature 341 and the first coils 342. In accordance with similar embodiments, the second actuator 350 may include or be provided as a linear actuator. In this or other cases, the second actuator 350 may include a second armature 351 through which the shaft 331 extends, second coils 352 surrounding the second armature 351 and a second actuator housing 353 that is supportive of the second bearing assembly 370 and configured to house the second armature 351 and the second coils 352.

Electrical insulation (isolation) of the plate 332 from the shaft assembly 330 can be achieved, for example, by material selection of the shaft isolation sleeve 3320.

With the first and second actuators 340 and 350 configured as described above, the first bearing assembly 360 is disposed to movably support the shaft 331 at the first side 3321 of the plate 332 and the second bearing assembly 370 is disposed to movably support the 331 shaft at the second side 3322 of the plate 332. The first bearing assembly 360 can include bearing elements that are secured in the first actuator housing 343 to permit movements of the shaft 331 along the longitudinal axis of the shaft 331 and the second bearing assembly can include bearing elements that are secured in the second actuator housing 353 to permit the movement of the shaft along the longitudinal axis of the shaft 331.

As shown in FIG. 3, the proximal ends of the electrically conductive bodies of the input and output leads 310 and 320 define or form a space or opening through which the shaft 331 extends, the first actuator 340 and the first bearing assembly 360 are disposed on a first side of the input and output leads 310 and 320 and the plate 332, the second actuator 350 and the second bearing assembly 370 are disposed on a second side of the input and output leads 310 and 320. In addition, as shown in FIG. 3, the elastic element 333 can include a first elastic element 3331, which is anchored at opposite ends thereof to the first actuator 340 and the shaft 331, and a second elastic element 3332, which is anchored at opposite ends thereof to the second actuator 350 and the shaft 331 or the plate 332.

During an operation of the relay contactor 301, the first and second coils 342 and 352 of the first and second actuators 340 and 350 can be independently or dependently energized to thus generate magnetic flux which brings the shaft 331 and the plate 332 into the closed position in opposition to the bias applied by the elastic element 333. To this end, the first and second coils 342 and 352 can be disposed in parallel or in series within an energization circuit and the elastic element 333 can be optimized for use with the various components of the first and second actuators 340 and 350.

Although FIG. 3 has been illustrated with first and second actuators 340 and 350, it is to be understood that this is not required. For example, certain embodiments exist in which the second actuator 350 is not included in the relay contactor 301. In these or other cases, the second bearing assembly 370 could include bearing elements that are secured to the housing 380 at the second side 3322 of the plate 332 and the second elastic element 3332 could be anchored at the opposite ends thereof to the housing 380 and the shaft 331 or the plate 332.

The elastic elements 3331 and 3332 can be electrically isolated from the plate 332 by the shaft isolation sleeve 3320.

Figure 4:
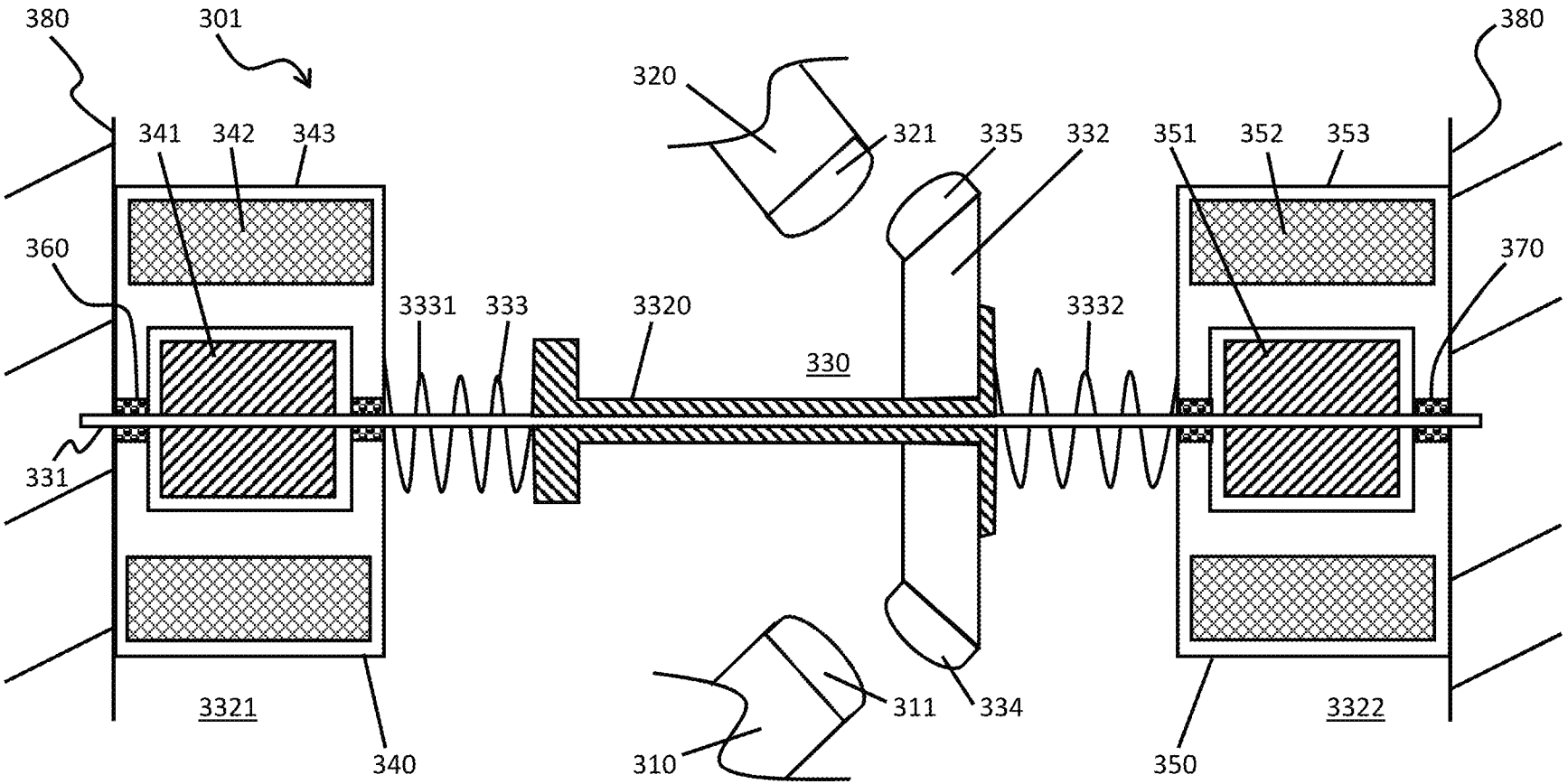
FIG. 4 is a side schematic illustration of a relay contactor for use with the aircraft distribution system of FIG. 1 and the primary power distribution board of FIG. 2 in accordance with alternative embodiments.

With reference to FIG. 4, the relay contactor 301 is illustrated in accordance with alternative embodiments in which the first and second electrical contacts 311 and 321 and the third and fourth electrical contacts 334 and 335 are disposed at an angle with respect to the longitudinal axis of the shaft 331.

Figure 5:
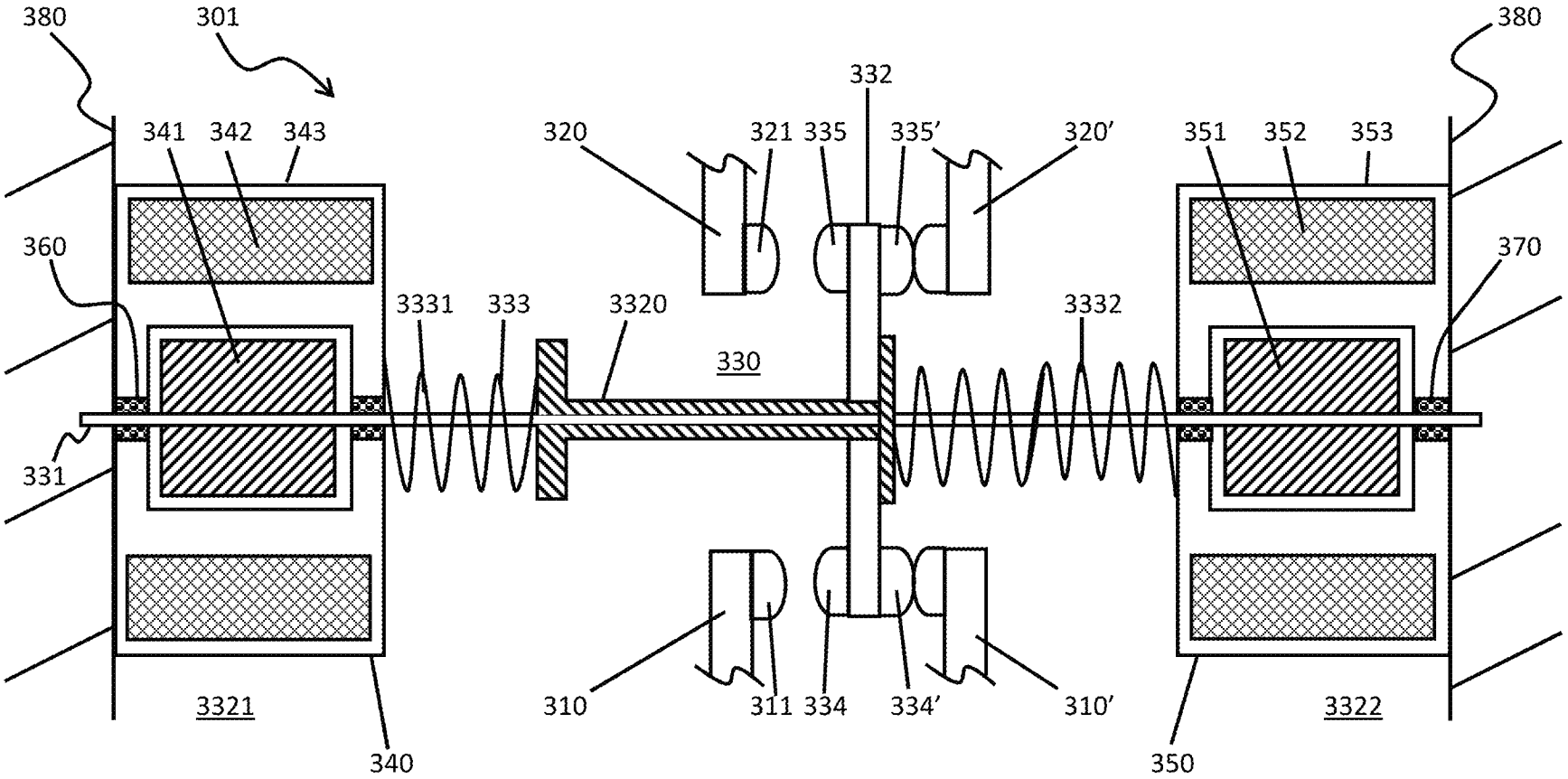
FIG. 5 is a side schematic illustration of a relay contactor for use with the aircraft distribution system of FIG. 1 and the primary power distribution board of FIG. 2 in accordance with alternative embodiments.
Figure 6:
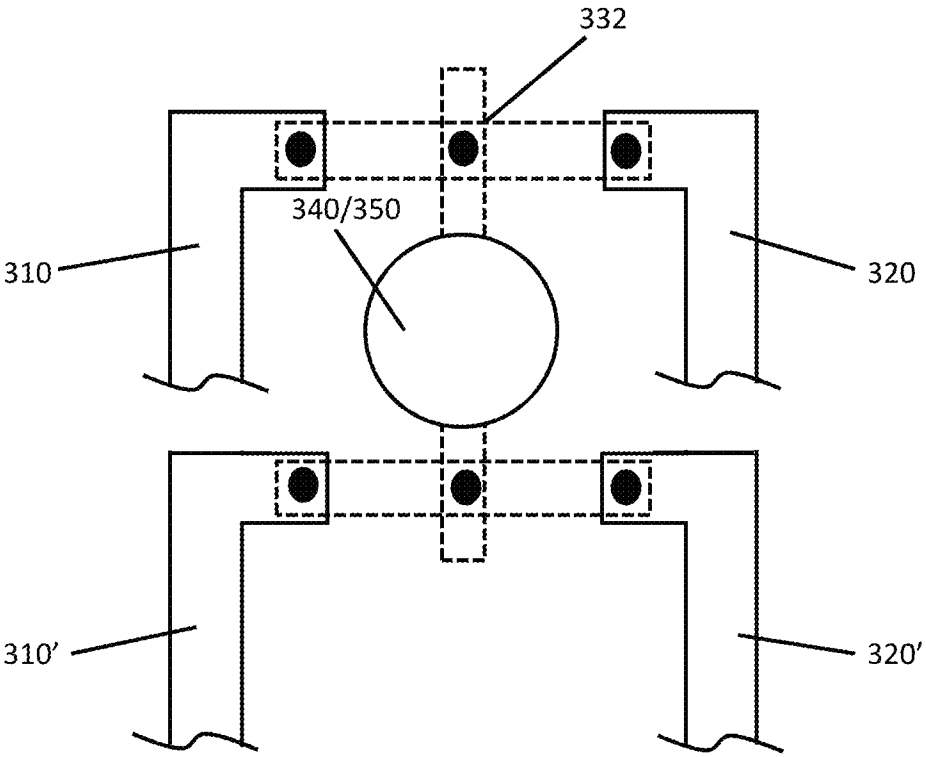
FIG. 6 is an axial schematic illustration of a relay contactor for use with the aircraft distribution system of FIG. 1 and the primary power distribution board of FIG. 2 in accordance with alternative embodiments.

With reference to FIGS. 5 and 6, the relay contactor 301 is illustrated in accordance with alternative embodiments in which the input and output leads 310 and 320 are provided as first and second pairs of input and output leads 310 and 320 and 310' and 320' and the shaft 331 and the plate 332 are movable between first and second positions at which the plate 332 is positioned at first and second positions with respect to the first and second pairs of the input and output leads 310 and 320 and 310' and 320'. As shown in FIG. 5, the first position is characterized in that the plate 332, which has additional third and fourth electrical contacts 334' and 335', is displaced from the first pair of the input and output leads 310 and 320 and in electrical contact with the second pair of the input and output leads 310' and 320' and the second position is characterized in that the plate 332 is displaced from the second pair of the input and output leads 310' and 320' and in electrical contact with the first pair of the input and output leads 310 and 320 (i.e., one of the first and second pairs of input and output leads 310 and 320 is normally open and the other of the first and second pairs of input and output leads 310' and 320' is normally closed). As shown in FIG. 6, the first position is characterized in that the plate 332 is displaced from the first and second pairs of the input and output leads 310 and 320 and 310' and 320' and the second position is characterized in that the plate 332 is in electrical contact with the first and second pairs of the input and output leads 310 and 320 and 310' and 320' (i.e., both the first and second pairs of input and output leads 310 and 320 and 310' and 320' are either normally open or closed).

Technical effects and benefits of the features described herein are the provision of a dual linear motor actuator with a compact size, capacity to handle heavy movable electrical contracts for small motor assemblies and a spring system optimized for an armature structure, electrical conductive material mass and dual coil (motor) power.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A relay contactor, comprising:

input and output leads;

a shaft assembly comprising a shaft, a plate disposed on the shaft and an elastic element, the shaft and the plate being movable between an open position at which the plate is displaced from the input and output leads and a closed position at which the plate contacts the input and output leads;

an actuator coupled to the shaft at a first side of the plate, the actuator being configured to selectively move the shaft and the plate into the closed position in opposition to bias applied by the elastic element; and first and second bearing assemblies disposed to movably support the shaft at the first side and at a second side of the plate, respectively, wherein the elastic element comprises a first elastic element anchored at opposite ends thereof to the first actuator and the shaft and a second elastic element anchored at opposite ends thereof to a second actuator and the shaft or the plate.

2. The relay contactor according to claim 1, further comprising a housing to house the input and output leads, the shaft assembly, the actuator and the first and second bearing assemblies.

3. The relay contactor according to claim 1, wherein:

the input and output leads comprise first and second conductive elements, respectively, and the plate comprises third and fourth conductive elements that are disposed to contact the first and second conductive elements, respectively, when the shaft and the plate are moved into the closed position.

4. The relay contactor according to claim 1, wherein, the shaft extends through a space defined between the input and output leads, the actuator and the first bearing assembly are disposed on a first side of the input and output leads, and the plate and the second bearing assembly are disposed on a second side of the input and output leads.

5. The relay contactor according to claim 1, wherein the actuator comprises a linear actuator.

6. The relay contactor according to claim 1, wherein the actuator comprises:

an armature through which the shaft extends;

coils surrounding the armature; and an actuator housing supportive of the first bearing assembly and configured to house the armature and the coils.

7. A relay contactor, comprising:

input and output leads;

a shaft assembly comprising a shaft, a plate disposed on the shaft and an elastic element, the shaft and the plate being movable between an open position at which the plate is displaced from the input and output leads and a closed position at which the plate contacts the input and output leads;

first and second actuators coupled to the shaft at first and second sides of the plate, respectively, and configured to selectively move the shaft and the plate into the closed position in opposition to bias applied by the elastic element; and first and second bearing assemblies disposed to movably support the shaft at the first and second sides of the plate, respectively, wherein the elastic element comprises a first elastic element anchored at opposite ends thereof to the first actuator and the shaft and a second elastic element anchored at opposite ends thereof to the second actuator and the shaft or the plate.

8. The relay contactor according to claim 7, further comprising a housing to house the input and output leads, the shaft assembly, the first and second actuators and the first and second bearing assemblies.

9. The relay contactor according to claim 7, wherein:

the input and output leads comprise first and second conductive elements, respectively, and the plate comprises third and fourth conductive elements that are disposed to contact the first and second conductive elements, respectively, when the shaft and the plate are moved into the closed position.

10. The relay contactor according to claim 9, wherein the first, second, third and fourth conductive elements are disposed at an angle.

11. The relay contactor according to claim 9, wherein the first, second, third and fourth conductive elements are hemispherical.

12. The relay contactor according to claim 7, wherein, the shaft extends through a space defined between the input and output leads, the first actuator and the first bearing assembly are disposed on a first side of the input and output leads, and the plate, the second actuator and the second bearing assembly are disposed on a second side of the input and output leads.

13. The relay contactor according to claim 7, wherein the first and second actuators are independently or dependently operable.

14. The relay contactor according to claim 7, wherein the first and second actuators each comprise a linear actuator.

15. The relay contactor according to claim 7, wherein:

the first actuator comprises a first armature through which the shaft extends, first coils surrounding the first armature and a first actuator housing supportive of the first bearing assembly and configured to house the first armature and the first coils, and the second actuator comprises a second armature through which the shaft extends, second coils surrounding the second armature and a second actuator housing supportive of the second bearing assembly and configured to house the second armature and the second coils.

* * * * *